US005386602A

United States Patent [19]

Krenzler

[11] Patent Number: 5,386,602

[45] Date of Patent: Feb. 7, 1995

[54] SLEEPING BAG WITH ADJUSTABLE/REMOVABLE MESH PANEL

[76] Inventor: Leo M. Krenzler, 1142 Industry Dr., Seattle, Wash. 98188

[21] Appl. No.: 38,459

[22] Filed: Mar. 29, 1993

[51] Int. Cl.[6] ..... A47C 17/64

[52] U.S. Cl. ..... 5/413; 2/69.5

[58] Field of Search ..... 2/69.5, DIG. 1, 69, 2/94, 83, 243.1; 5/413, 414, 417, 460, 468

[56] References Cited

U.S. PATENT DOCUMENTS

| | | | |
|---|---|---|---|
| 1,267,551 | 5/1918 | Jacobs | 5/413 |
| 1,699,002 | 1/1929 | Leibold | 5/413 |
| 1,805,415 | 5/1931 | Pendarvis et al. | 5/413 |
| 2,341,069 | 2/1944 | Anderson | 5/413 |
| 2,841,803 | 7/1958 | Bodling | 5/414 |
| 3,153,793 | 10/1964 | Lepore | 2/DIG. 1 |
| 3,536,083 | 10/1970 | Reynolds | 5/414 |
| 4,125,910 | 11/1978 | Nicholai | 2/69.5 |
| 4,192,030 | 3/1980 | Casson | 2/69.5 |
| 4,532,654 | 8/1985 | Sigismonde | 2/69.5 |
| 4,608,715 | 9/1986 | Miller et al. | 2/DIG. 1 |
| 4,901,371 | 2/1990 | Christians | 2/69.5 |

*Primary Examiner*—Clifford D. Crowder
*Assistant Examiner*—Amy B. Vanatta
*Attorney, Agent, or Firm*—Glenn D. Bellamy; Kathleen T. Petrich

[57] ABSTRACT

A sleeping bag with a flexible mesh ventilation panel. A removable and adjustable ventilation panel spans an elongated access opening of the sleeping bag and attaches to edge portions of the opening via an adjustable closure device, such as a zipper.

17 Claims, 2 Drawing Sheets

SLEEPING BAG WITH ADJUSTABLE/REMOVABLE MESH PANEL

TECHNICAL FIELD

This application relates to a sleeping bag having an adjustable and removable ventilation/insect-excluding panel that attaches along a longitudinal opening of a sleeping bag.

BACKGROUND OF THE INVENTION

Sleeping bags have been a common and welcome invention of the camper and individuals who enjoy the outdoors. Blankets and sheets are generally too cumbersome for use in camping situations and they leave the user uncovered during normal sleep patterns. Sleeping bags generally include a back layer and a front layer folded over to form a common edge along one longitudinal side. An elongated opening between the front and back layers formed along a bottom edge and the opposite longitudinal edge usually includes some adjustable closure device, such as a zipper. A top edge is usually left open, allowing a user's head to protrude. This type of bag offers the user warmth and some protection from rocks, dirt and small animals and insects when the user is inside the sleeping bag with the sleeping bag closed. The only exposed body part of the user is the head, and possibly upper arms, through the top edge opening.

In warm climates or seasons however, sleeping bags can be and often are too warm for the user when totally closed. It is possible to partially or fully open the sleeping bag closure, but the occupant often, through a night of normal movement, becomes partially or entirely uncovered. This can leave the user too cold and exposed to dirt, rocks, insects or other pests. Until now, there has not been an adequate sleeping bag that protects the user from the cold and other environmental elements, but adjustably provides air circulation and ventilation to the user to avoid overheating.

SUMMARY OF THE INVENTION

This invention provides a ventilated sleeping bag with an adjustable mesh panel that attaches to the outer edges of the sleeping bag and spans an elongated opening of the bag. This ventilated sleeping bag has various uses. In warm weather, the user can open the sleeping bag zipper and leave the outer mesh panel in place to ventilate and cool the user in a controlled manner without the worry of becoming partially or fully uncovered during the night. In cooler weather, the user can adjustably close both the sleeping bag zipper and the mesh panel for extra protection against the cold.

Because the mesh panel attaches to edge portions of the sleeping bag, the panel can be used with other variations of a standard sleeping bag. For example, if the sleeping bag has a zipper down the center of the top panel, as opposed to the side, the mesh panel of the present invention can accommodate this style, as well.

The mesh ventilation panel can also be used where two sleeping bags are zipped or closed together. In this situation, one or two mesh panels can be attached to the outer and bottom edges of either one or both of the sleeping bags. This provides adjustable ventilation for either or both occupants of the double sleeping bag.

In preferred form, the mesh panel may be a fabric woven such that the openings are sized to exclude commonly-encountered insects.

BRIEF DESCRIPTION OF THE DRAWINGS

Like reference numerals are used to refer to like parts throughout the various figures of the drawing, wherein.

BEST MODE FOR CARRYING OUT THE INVENTION

Figures 1, 5:
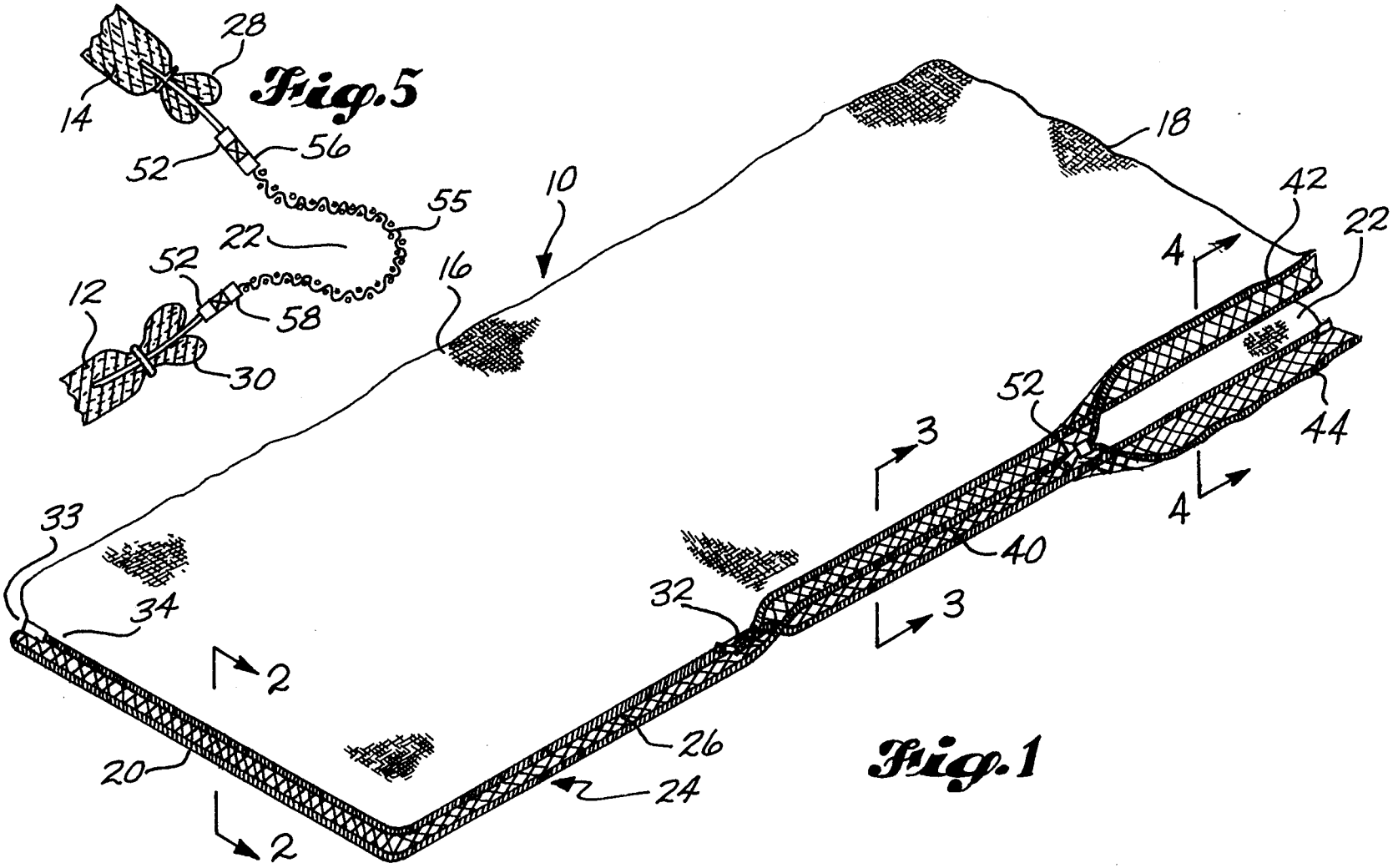
FIG. 1 is a pictorial view of the sleeping bag with a ventilation panel according to the preferred embodiment of the invention shown in a partially detached position.
FIG. 5 is a sectional view showing another embodiment of the invention in which the ventilation panel is attached to opposite parts of the sleeping bag's standard closure device.

Referring to the several figures of the drawing, and first to FIG. 1, therein is shown at 10 a typical sleeping bag constructed according to the preferred embodiment of the invention. The sleeping bag 10 has a back layer 12, a front layer 14, and is folded along a common longitudinal edge 16. The user would lay between the back layer 12 and front layer 14. The sleeping bag 10 also has a top open edge 18 so that the user's head, and perhaps upper shoulders and arms, have free access to air. The bag 10 has a bottom edge 20 where the user would normally place his or her feet. The sleeping bag 10 has an opening 22 between the front and back layers 12, 14 that runs along the length of the sleeping bag 10 along a longitudinal edge 24, which is opposite the folded edge 16. The opening 22 continues across the bottom edge 20. This opening 22, along with the open top edge 18, is normally where the user gains access to and from the sleeping bag.

Figure 2:
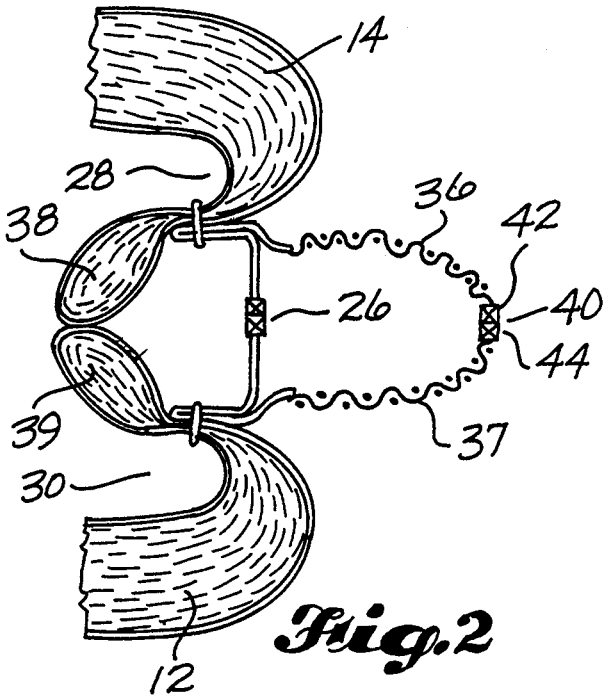
FIG. 2 is a sectional view, taken substantially along line 2—2 of FIG. 1, showing the sleeping bag in the closed position and the ventilation panel shown in a closed position.
Figure 3:
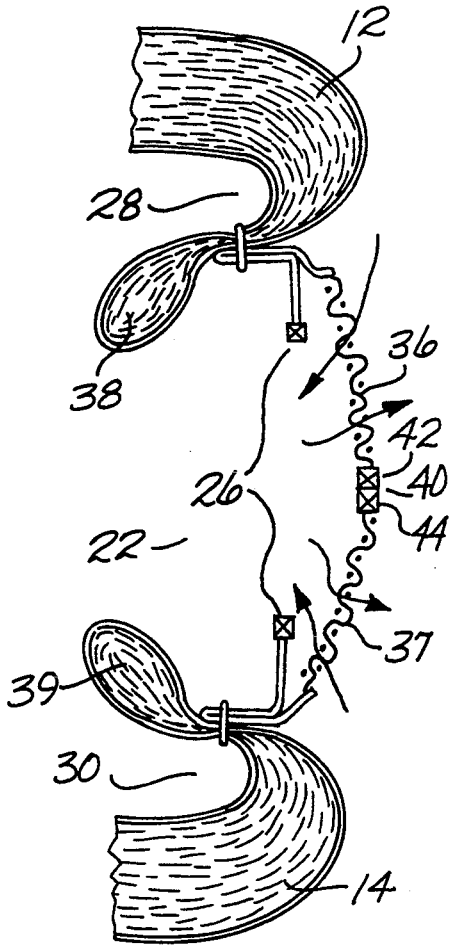
FIG. 3 is a sectional view, taken substantially along line 3—3 of FIG. 1, showing the sleeping bag closure left open and the ventilation panel closed.
Figure 4:
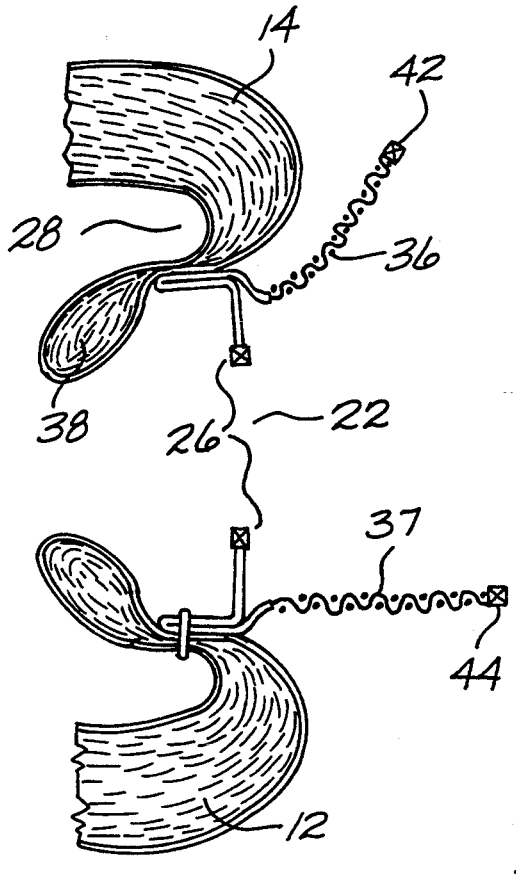
FIG. 4 is a sectional view, taken substantially along line 4—4 of FIG. 1, showing the sleeping bag open and the ventilation panel left open.

Referring also to FIGS. 2, 3 and 4, in preferred form, the opening 22 is closed by a two-ended zipper 26. The zipper 26 is sewn in along upper and lower edges 28, 30 of the open longitudinal side 26 and bottom edge 20. As is commonly used with ordinary sleeping bags, it is preferred that the zipper 26 include sliders or "heads" 32, 34 movable from opposite ends thereof. In this manner, the sleeping bag 10 may be open along the side 24 by separating the zipper beginning at the top edge 18 and moving the slider 32 toward the bottom edge 20. The sleeping bag 10 may be completely open in this manner, if desired, by continuing to separate the zipper 26 all the way across the bottom edge 20. Alternatively, just the foot area of the sleeping bag 10 can be opened by separating the zipper 26 along the bottom edge 20, beginning from the corner 33 at the folded edge 16. In this manner, slider 34 is moved across the bottom edge 20, separating the zipper 26 to the extent desired. In order to provide adequate insulation and protection from the cold, protective flaps 38, 39 may extend from edges 28, 30. These flaps 38, 39 also keep the user separated from direct contact with the zipper 26.

Extending from each edge 28, 30 to span the opening 22 are ventilating mesh panels 36, 37. The mesh panels 36, 37 are attachable to each other by a second zipper 40. The zipper 40 includes opposite intermeshing rows of teeth 42, 44, which are adjustably joinable and separable.

In preferred form, each mesh panel 36, 37 would be from ¾ inch to one inch in width and would be made of a durable and flexible woven screen material or netting having openings sized to exclude insects. The panels 36, 37 could be made form ordinary nylon or glass fiber mosquito netting or could be perforated panels of some other suitable material. Typically, it would only be necessary to include a single slider or "head" 52 on the zippers 40 because adjustment and opening would ordinarily be made from the top edge, such as is shown in FIG. 1.

Referring specifically to FIG. 2, it can be seen that the mesh panels 36, 37 do not interfere with normal closure of the sleeping bag opening 22. The main zipper 26 can be closed without interference with the flexible mesh of the panels 36, 37. A sleeping bag of the present invention may be used in this manner such as when the weather becomes colder, requiring non-ventilating closure of the sleeping bag. Also, the user whose feet are prone to become colder than the rest of his or her body may close the main zipper 26 along the foot and lower leg region of the sleeping bag, as shown in FIG. 1. In such condition, the mesh panels 36, 37 are performing no significant function along the areas of the bag where the main zipper 26 is closed.

Referring to FIG. 3, it can be seen that the main zipper 26 can be opened allowing ventilating airflow to exchange from inside to outside the sleeping bag 10 through the mesh panels 36, 37. In this situation, the mesh panels 36, 37 provide a controlled ventilation of the sleeping bag 10 without allowing the front and back layers 12, 14 to become completely separated.

If the user's feet and legs, for example, are prone to becoming warmer than the rest of his or her body, the main zipper 26 could be opened along the bottom edge 20 by movement of the slider 34, while leaving the mesh panel 36 in place along the bottom edge 20 and while leaving the main zipper 26 closed along part or all of the longitudinal side 24. This will allow ventilation to the user's feet and legs without allowing them to become completely uncovered or exposed to dirt and insects.

Referring now to FIG. 4, it can be seen that the upper and lower edges 28, 30 of the sleeping bag 10 can be completely separated, if desired. Complete separation will allow the user to enter and exit the bag or to adjust the opening 22 at the upper end to allow the user's shoulders and/or upper body to be partially or completely uncovered while the lower portion of the user's body remains covered. Because the mesh panels 36, 37 are flexible and lightweight, they pose no significant interference to normal opening or use of the sleeping bag 10. If desired, one panel 36 could be reduced in width in proportion to an increase in width to the other panel 37. It is not mandatory, although it is preferred, that the zipper 40 be centered between the edges 28, 30.

Referring to FIG. 5, therein is shown an alternate embodiment of the present invention. In this embodiment, the upper and lower edges 28, 30 of the sleeping bag 10 include singular rows of zipper teeth 52, 54, as is the case in an ordinary sleeping bag. A flexible mesh panel 55 has rows of intermeshing zipper teeth 56, 58 along opposite longitudinal edges. These rows of zipper teeth 56, 58 are attachable to the rows of zipper teeth 52, 54 on the sleeping bag edges 28, 30. In this manner, the mesh panel 55 can be used as shown to provide controlled ventilation along the longitudinal opening 22. If desired, the mesh panel 55 may be unzipped from the sleeping bag and the mating rows of zipper teeth 52, 54 can be used to close the sleeping bag in the traditional way. While this embodiment provides less versatility and adjustability than the previously-described embodiment, it allows the mesh panel 55 of the present invention to be retrofitted onto an ordinary sleeping bag.

As is commonly understood, a pair of ordinary sleeping bags can be zipped together for use as a double sleeping bag. In such case, each bag is completely unzipped and laid out flat in an unfolded position, one atop the other. Opposite halves of each sleeping bag's zipper are then engaged together to connect the two sleeping bags along their outer perimeter. Both illustrated embodiments of the present invention are ideally suited for such double-sleeping bag use. The main zippers 26 would engage together and the mesh panels 36, 37 and 55 from each of the two sleeping bags would be used along opposite side edges and along its respective half of the bottom edge. Such an arrangement is ideal when one of the users is normally warmer or cooler than the other. Each user can adjustably control the ventilation along his or her half of the sleeping bag without significantly affecting the other user. The double sleeping bag arrangement also retains the separate adjustability of ventilation in the foot region.

The present invention may also be used in conjunction with sleeping bags having an elongated opening which is located in the top panel, rather than along a longitudinal edge. Such sleeping bags are commonly referred to as a "mummy" type. In a "mummy" type bag, the above-described mesh panel could be adapted to span the opening created down the front of the bag, thereby providing adjustable ventilation. The present invention is also ideal for use in conjunction with sleeping bags that provide a mosquito netting or other screening for protection of the user's head.

It is to be understood that many variations may be made in the illustrated and above-described embodiments without departing from the spirit and scope of my invention. For this reason, my patent protection is not to be limited by these preferred embodiments, but rather only by the below-appended claim or claims interpreted according to accepted doctrines of claim interpretation, including the doctrine of equivalents and reversal of parts.

What is claimed is:

1. A ventilated sleeping bag, comprising:

a sleeping bag having opposed front and back layers, and an elongated opening defined by edge portions of said front and back layers;

the front and back layers defining an interior for accommodating a person, the elongated opening being of sufficient size to accommodate ingress and egress of a person into and out of said elongated opening.

a closure mechanism along said edge portions for opening and closing said elongated opening by separating said edge portions and bringing said edge portions together; and an elongated mesh panel secured to said edge portions of said opening such that said mesh panel spans between said edge portions when said elongated opening is not closed by said closure mechanism, the closure mechanism being positioned interior of the sleeping bag with respect to the mesh panel.

2. The sleeping bag of claim 1, wherein the mesh panel is made of a flexible woven mesh.

3. The sleeping bag of claim 1, wherein said mesh panel includes openings sized to exclude insects.

4. The sleeping bag of claim 1, wherein said sleeping bag closure mechanism is a zipper.

5. The sleeping bag of claim 1, wherein said sleeping bag closure mechanism is adjustable.

6. The sleeping bag of claim 4, wherein said mesh panel is secured to said edge portions of said opening in an adjustable manner so that said mesh panel can be conveniently adjusted between fully attached and partially attached positions.

7. The sleeping bag of claim 6, wherein the mesh panel is adjustably attached to the sleeping bag opening by a zipper.

8. The ventilated sleeping bag of claim 1, wherein said sleeping bag is elongated so that it has a longitudinal dimension, and wherein said elongated opening extends substantially along the longitudinal dimension of said sleeping bag.

9. The ventilated sleeping bag of claim 8, wherein said elongated mesh panel includes a closure mechanism along its length for opening and closing said elongated mesh panel.

10. The ventilated sleeping bag of claim 9, wherein the closure mechanism of the elongated mesh panel is a zipper.

11. The ventilated sleeping bag of claim 1, wherein the closure mechanism opens and closes the elongated opening by unsecuring and securing the edge portions of the opening together.

12. The ventilated sleeping bag of claim 1, wherein the elongated mesh panel is securable to the closure mechanism along the edge portions of the opening when the opening is not closed by the closure mechanism.

13. A mesh panel for use with a sleeping bag having opposed front and back layers, and a longitudinal elongated opening defined by edge portions of the front and back layers, the front and back layers defining an interior for accommodating a person, and a closure mechanism along said edge portions for opening and closing said elongated opening by separating said edge portions and bringing said edge portions together, said mesh panel comprising:

an elongated mesh panel attachable along opposite longitudinal edges of the panel to the edge portions of the elongated opening of the sleeping bag such that said mesh panel spans between said edge portions when said elongated opening is not closed by said closure mechanism, the closure mechanism being positioned interior of the sleeping bag with respect to the mesh panel.

14. The mesh panel of claim 13, wherein said mesh panel is made of a flexible woven fabric.

15. The mesh panel of claim 13, wherein said mesh panel includes openings sized to exclude insects.

16. The mesh panel of claim 13, wherein the attachment of said mesh panel is adjustable between fully attached and partially attached positions.

17. The mesh panel of claim 16, wherein said mesh panel is adjustably attached to the sleeping bag edge portions by a zipper.

* * * * *

UNITED STATES PATENT AND TRADEMARK OFFICE

CERTIFICATE OF CORRECTION

PATENT NO. : 5,386,602

DATED : February 7, 1995

INVENTOR(S) : Leo M. Krenzler

It is certified that error appears in the above-identified patent and that said Letters Patent is hereby corrected as shown below:

Claim 1, column 4, line 57, delete the period after "opening".

Signed and Sealed this

Eighteenth Day of July, 1995

*Attest:*

Bruce Lehman

BRUCE LEHMAN

*Attesting Officer*

*Commissioner of Patents and Trademarks*